US011341872B2

(12) United States Patent
Lee

(10) Patent No.: US 11,341,872 B2
(45) Date of Patent: May 24, 2022

(54) BACKPLATE AND ROLLABLE DISPLAY DEVICE INCLUDING THE SAME

(71) Applicant: LG Display Co., Ltd., Seoul (KR)

(72) Inventor: Seung-Hee Lee, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 148 days.

(21) Appl. No.: 16/708,187

(22) Filed: Dec. 9, 2019

(65) Prior Publication Data

US 2020/0184857 A1 Jun. 11, 2020

(30) Foreign Application Priority Data

Dec. 10, 2018 (KR) ..... 10-2018-0158559

(51) Int. Cl.
*G09F 9/30* (2006.01)

(52) U.S. Cl.
CPC ..... *G09F 9/301* (2013.01)

(58) Field of Classification Search
CPC ..... G09F 9/301; G06F 1/1652; G09G 3/035; H01L 27/3244; H01L 51/0097
See application file for complete search history.

(56) References Cited

U.S. PATENT DOCUMENTS 9,983,424 B2 * 5/2018 Kim ..... H01L 51/0097
10,866,618 B2 * 12/2020 Yeom ..... G06F 1/1626
2010/0127965 A1 * 5/2010 Park ..... G09F 9/33 345/105
2016/0320804 A1 * 11/2016 Takayanagi ..... G06F 1/1679
2017/0034906 A1 * 2/2017 Myung ..... H05K 1/0281
2017/0170417 A1 * 6/2017 Myung ..... H01L 51/0097
2018/0351117 A1 12/2018 Kim
2019/0067606 A1 * 2/2019 Han ..... H01L 51/5237
2019/0141843 A1 * 5/2019 Park ..... H05K 1/189
2019/0187752 A1 * 6/2019 Lee ..... G06F 1/1679

FOREIGN PATENT DOCUMENTS

CN 102239683 A 11/2011
CN 105741683 A 7/2016
CN 106652802 A 5/2017
CN 107393942 A 11/2017
CN 107492309 A 12/2017
CN 108470523 A 8/2018
(Continued)

*Primary Examiner* — Joe H Cheng
(74) *Attorney, Agent, or Firm* — Seed IP Law Group LLP

(57) ABSTRACT

The present disclosure provides a backplate including a first plate coupled to the rear surface of a flexible display panel, a second plate disposed opposite the first plate while being spaced apart therefrom, and an elastic part disposed between the first plate and the second plate and configured to resiliently change a distance between the first plate and the second plate. The present disclosure further provides a rollable display device including a flexible display panel, a backplate coupled to the rear surface of the flexible display panel, and a case accommodating a roller configured to roll or unroll the flexible display panel and the backplate together and having therein an entrance through which the flexible display panel and the backplate are introduced into or drawn out of the case. When the flexible display panel and the backplate are rolled around the roller, the backplate is gradually reduced in thickness.

20 Claims, 10 Drawing Sheets

(56) References Cited

FOREIGN PATENT DOCUMENTS

| | | | |
|---|---|---|---|
| CN | 208014279 | U | 10/2018 |
| CN | 108877530 | A | 11/2018 |
| CN | 110369549 | A | 10/2019 |
| KR | 10-2016-0013289 | A | 2/2016 |
| KR | 10-2017-0139733 | A | 12/2017 |

* cited by examiner

BACKPLATE AND ROLLABLE DISPLAY DEVICE INCLUDING THE SAME

CROSS-REFERENCE TO RELATED APPLICATION

This application claims the benefit of Korean Patent Application No. 10-2018-0158559, filed on Dec. 10, 2018, which is hereby incorporated by reference as if fully set forth herein.

BACKGROUND

Technical Field

The present disclosure relates to a backplate and a rollable display device including the same, and more particularly to a backplate, which is configured to be rolled around a roller together with a flexible display panel and to securely support the rear surface of the flexible display panel when unrolled from the roller, and a rollable display device including the same.

Description of the Related Art

An image display device, which realizes various pieces of information on a screen, is a core technology of the information and communication age, and is being developed in the direction of becoming thinner and lighter and having higher performance. As a flat panel display device that is capable of overcoming the problems of disadvantageous weight and volume of a cathode ray tube (CRT), for example, an organic light-emitting display device, which uses a self-illuminating organic light-emitting element and therefore does not require a separate light source, is attracting attention.

Such an organic light-emitting display device displays an image using a plurality of pixels, which are arranged in a matrix form. Here, each pixel includes a light-emitting element and a pixel-driving circuit having multiple transistors that implement independent driving of the light-emitting element.

Recently, in terms of various applications, there is increasing demand for flexible display devices, which can be conveniently carried in a pocket or purse and which can display an image on a larger screen than when carried. A flexible display device is maintained in a folded or bent state when carried or stored, and is unfolded in order to display an image, whereby an image display region increases, the visibility to a user is improved, and a more realistic image is provided to a user.

In particular, among various types of flexible display devices, research on a rollable display device having excellent portability and providing a large display area when unrolled from a rolled-up state is being actively conducted.

A rollable display device is stored or carried in the state in which a display unit is rolled around a roller, and displays an image in the state in which the display unit is unrolled from the roller. However, it is difficult for a flexible panel to maintain a constant shape in the state in which the display unit is unrolled from the roller. Further, if a sturdy frame is added to solve this problem, the thickness of the display unit in the state of being rolled around the roller increases.

BRIEF SUMMARY

Accordingly, the present disclosure is directed to a backplate and a rollable display device including the same that substantially obviate one or more problems due to the limitations and disadvantages of the related art.

Described herein is a backplate that is configured to securely fix and support the rear surface of a flexible display panel and to be reduced in thickness when rolled around a roller together with the flexible display panel, and a rollable display device including the same.

Described herein is a backplate including a first plate coupled to the rear surface of a flexible display panel configured to be bent smoothly, a second plate disposed opposite the first plate while being spaced apart therefrom, and an elastic part disposed between the first plate and the second plate, the elastic part being configured to resiliently change a thickness or a gap between the first plate and the second plate.

Also described herein is a rollable display device including a flexible display panel configured to be bent smoothly, a backplate coupled to the rear surface of the flexible display panel, and a case accommodating a roller configured to roll or unroll the flexible display panel and the backplate together, the case having therein an entrance through which the flexible display panel and the backplate are together introduced into or drawn out of the case, wherein, when the flexible display panel and the backplate are rolled around the roller and are accommodated in the case through the entrance, the backplate is gradually reduced in thickness.

A backplate may be summarized as comprising: a first plate coupled to a rear surface of a flexible display panel configured to be bent smoothly; a second plate spaced apart from the first plate and located opposite to the first plate across a space between the first plate and the second plate; and an elastic layer located between the first plate and the second plate, the elastic layer configured to resiliently change a distance between the first plate and the second plate.

At least one of the first plate or the second plate may have through-holes extending from a front surface thereof to a rear surface thereof. The first plate, the second plate, and the elastic layer may be rolled up together such that the first plate is located at an outer side and the second plate is located at an inner side. The elastic layer may comprise: a plurality of pads that extend parallel to each other and that are spaced apart from each other, wherein each of the pads is coupled at opposite side surfaces thereof to a surface of the first plate and a surface of the second plate that face each other, and wherein each of the pads is configured to be resiliently changed in thickness; and a plurality of rolling tubes coupled to any one of the first plate and the second plate, each of the rolling tubes located between two adjacent ones of the pads and extending parallel to the pads.

In an at least partially unrolled state, each of the rolling tubes may comprise:

a first surface located at a first side thereof, the first surface having a U-shaped cross-section; a second surface located at a second side thereof opposite to the first side, the second surface having a concave shape; and support legs located at opposite ends of the first surface or the second surface. When the distance between the first plate and the second plate is reduced, each of the rolling tubes may be rolled up such that the first surface is located at an inner side and the second surface is located at an outer side in a direction in which the first plate, the second plate and the elastic layer are rolled up together.

When each of the rolling tubes is rolled up, curling force may be generated in each of the rolling tubes in a rolling direction, and when each of the rolling tubes is spread, supporting force may be generated in each of the rolling tubes to maintain the first plate and the second plate to be planar in shape. When the first plate and the second plate spread into a planar shape, each of the rolling tubes may be increased in height to increase the distance between the first plate and the second plate. The elastic layer may comprise: a plurality of pads extending parallel to each other and spaced apart from each other, each of the pads coupled to a surface of the first plate and a surface of the second plate that face each other, each of the pads configured to be resiliently changed in thickness; and a plurality of members of flexible material, each of the members located between two adjacent ones of the pads, each of the members having an S-shaped cross-section and comprising a first attachment portion coupled to the first plate, the first attachment portion corresponding to a front surface of one end portion of the member, a second attachment portion coupled to the second plate, the second attachment portion corresponding to a rear surface of an opposite end portion of the member, and a connection portion resiliently connecting the first attachment portion and the second attachment portion.

Each of the pads may be attached at one end portion thereof to a rear surface of the first plate and may be attached at an opposite end portion thereof to a front surface of the second attachment portion. A direction in which the members of elastic material extend from the first plate to the second plate to connect the first plate and the second plate may be uniform. When a shortest straight-line distance between the first plate and the second plate is changed, the elastic layer may cause the first plate and the second plate to slip in a direction perpendicular to a direction in which the shortest straight-line distance between the first plate and the second plate is changed. The backplate may further comprise an edge seal located at an edge area of the first plate and an edge area of the second plate between the first plate and the second plate.

A rollable display device may be summarized as comprising: a flexible display panel configured to be bent smoothly; a backplate coupled to a rear surface of the flexible display panel; and a case accommodating a roller configured to roll or unroll the flexible display panel and the backplate together, the case having an entrance through which the flexible display panel and the backplate are together introduced into or drawn out of the case; wherein, when the flexible display panel and the backplate are rolled around the roller and are accommodated in the case through the entrance, the backplate is gradually reduced in thickness.

The backplate may comprise: a first plate coupled to the rear surface of the flexible display panel; a second plate spaced apart from the first plate and located opposite to the first plate across a space between the first plate and the second plate; an elastic layer located between the first plate and the second plate, the elastic layer configured to resiliently change a distance between the first plate and the second plate; and an edge seal located at an edge area of the first plate and an edge area of the second plate between the first plate and the second plate. The elastic layer may comprise: a plurality of pads extending parallel to each other and spaced apart from each other, each of the pads coupled at opposite side surfaces thereof to a surface of the first plate and a surface of the second plate that face each other, each of the pads configured to be resiliently changed in thickness; and a plurality of rolling tubes coupled to any one of the first plate and the second plate, each of the rolling tubes located between two adjacent ones of the pads and extending parallel to the pads.

When each of the rolling tubes is rolled up, curling force may be generated in each of the rolling tubes in a rolling direction, and when each of the rolling tubes is spread, supporting force may be generated in each of the rolling tubes to maintain the first plate and the second plate to be planar in shape. The elastic layer may comprise: a plurality of pads extending parallel to each other and spaced apart from each other, each of the pads coupled to a surface of the first plate and a surface of the second plate that face each other, each of the pads configured to be resiliently changed in thickness; and a plurality of members of flexible material, each of the members located between two adjacent ones of the pads, each of the members having an S-shaped cross-section and comprising a first attachment portion coupled to the first plate, the first attachment portion corresponding to a front surface of one end portion of the member, a second attachment portion coupled to the second plate, the second attachment portion corresponding to a rear surface of an opposite end portion of the member, and a connection portion resiliently connecting the first attachment portion and the second attachment portion.

When a shortest straight-line distance between the first plate and the second plate is changed, the elastic layer may cause the first plate and the second plate to slip in a direction perpendicular to a direction in which the shortest straight-line distance between the first plate and the second plate is changed, and the second plate may slip closer to the entrance of the roller than the first plate.

It is to be understood that both the foregoing general description and the following detailed description of the present disclosure are exemplary and explanatory.

BRIEF DESCRIPTION OF THE SEVERAL VIEWS OF THE DRAWINGS

The accompanying drawings, which are included to provide a further understanding of the disclosure and are incorporated in and constitute a part of this application, illustrate embodiment(s) of the disclosure. In the drawings.

DETAILED DESCRIPTION

Figure 1:
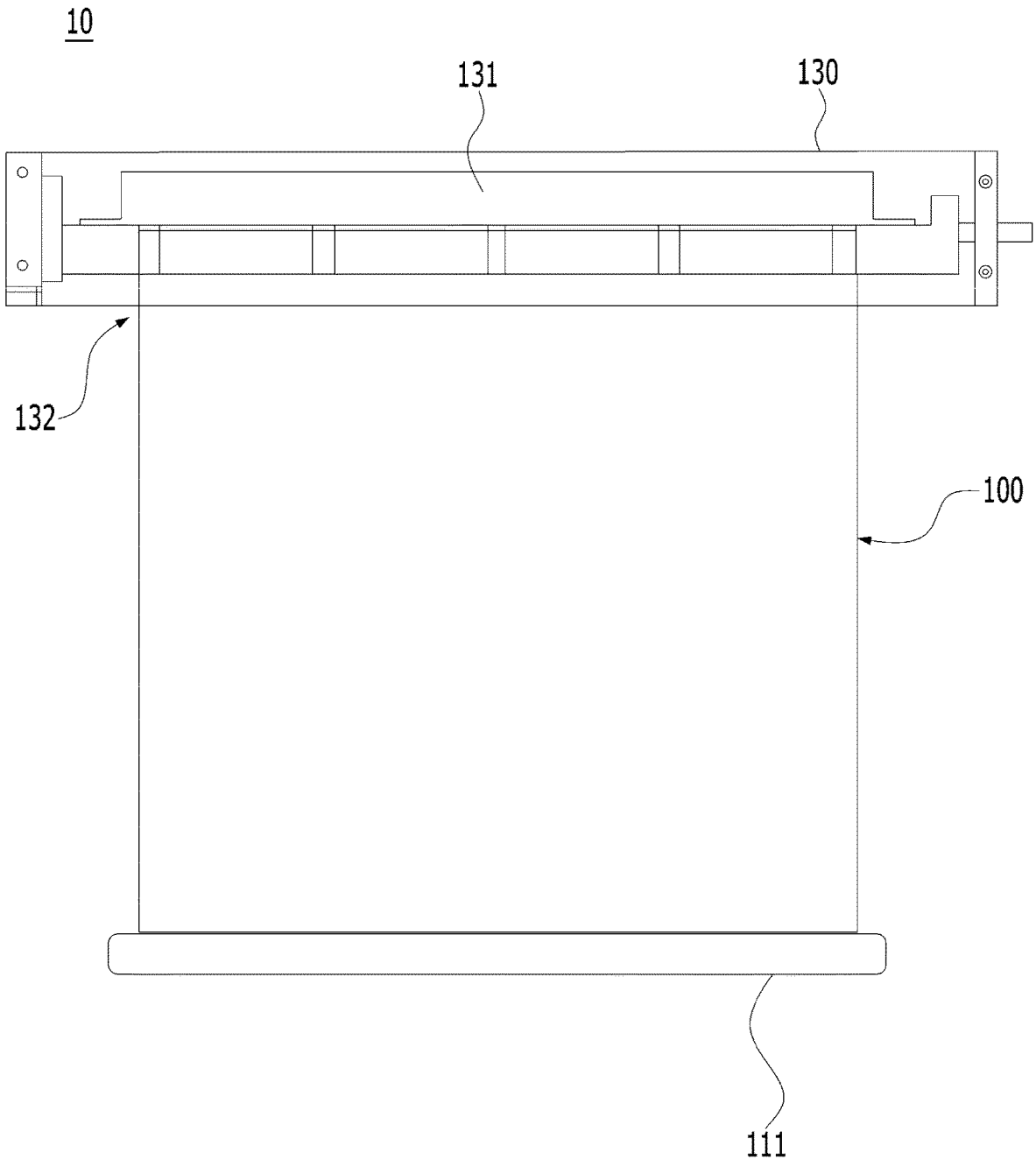
FIG. 1 is a front view of a rollable display device.

Reference will now be made in detail to the preferred embodiments, examples of which are illustrated in the accompanying drawings. In the drawings, the same or similar elements are denoted by the same reference numerals even though they are depicted in different drawings. In the following description, a detailed description of known functions or known configurations incorporated herein will be omitted when it may make the subject matter rather unclear. Some features illustrated in the drawings are exaggerated, reduced or simplified for convenience in description and clarity, and the drawings and elements in the drawings are not always illustrated at the actual scale. However, these details will be easily understood by those skilled in the art.

Figure 2:
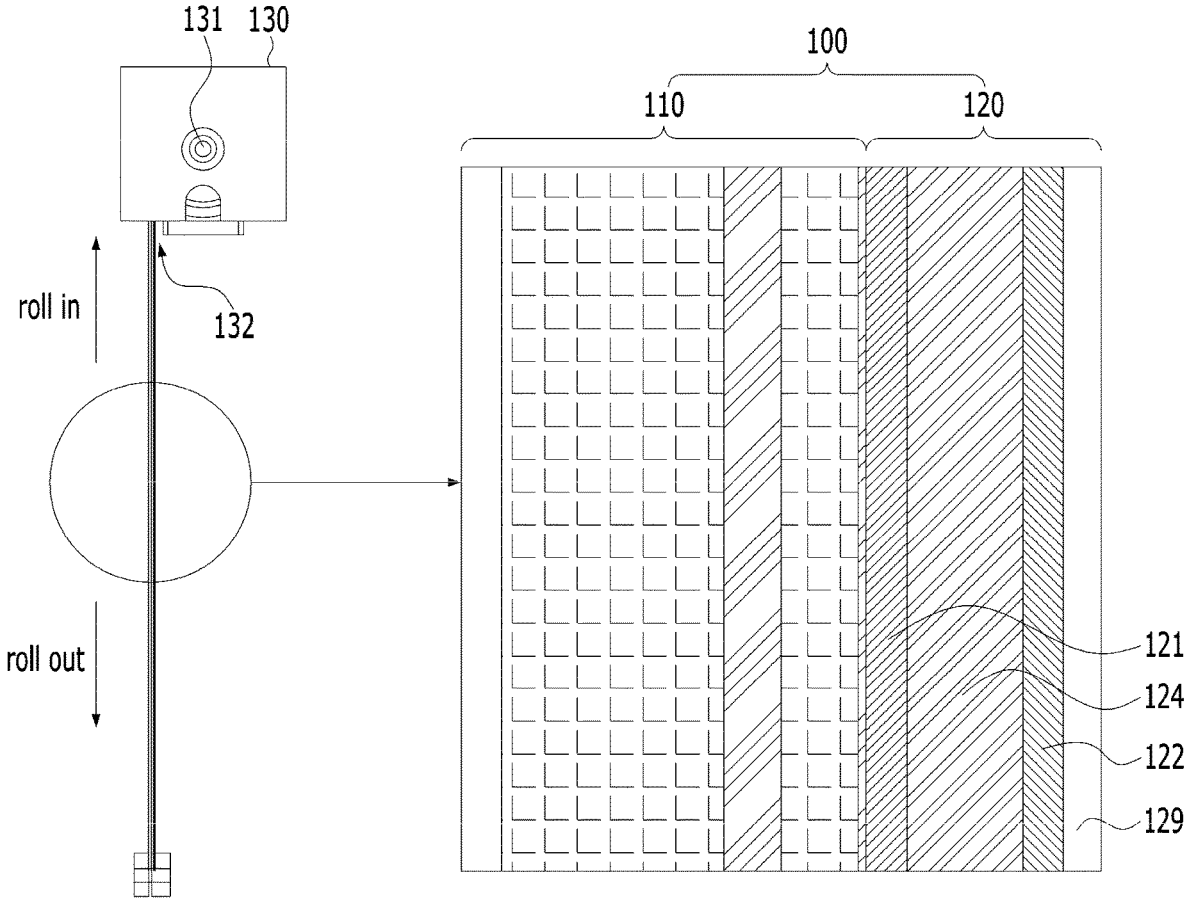
FIG. 2 shows a side view of the rollable display device shown in FIG. 1 and a partially enlarged view of a portion of the cross-section of a display unit.

FIG. 1 is a front view of a rollable display device, and FIG. 2 shows a side view of the rollable display device shown in FIG. 1 and a partially enlarged view of a portion of the cross-section of a display unit.

Referring to FIGS. 1 and 2, a rollable display device 10 includes a flexible display panel 110, a backplate 120, and a case 130.

The flexible display panel 110 includes a display area formed in the front surface thereof, and is coupled at the rear surface thereof to the backplate 120. The flexible display panel 110 may be embodied as a soft self-illuminating display panel such as, for example, an organic light-emitting display panel. The flexible display panel 110 and the backplate 120 form a display unit 100. The display unit 100 is configured to be rolled around or unrolled from a roller 131, which is provided in the case 130. When the display unit 100 is rolled around the roller 131, the volume thereof decreases, thus facilitating storage and improving portability. When the display unit 100 is unrolled from the roller 131, the display area increases, thus easily displaying an image on a large screen.

The backplate 120 is coupled to the rear surface of the flexible display panel 110. The backplate 120 has higher rigidity or elasticity than the flexible display panel 110, and thus functions to prevent the flexible display panel 110, which is soft, from shaking or overturning due to external force and to support the flexible display panel 110 so that the flexible display panel 110 maintains a constant shape.

The backplate 120 includes a first plate 121, a second plate 122, and a flexible or elastic layer, which may be referred to herein as an "elastic member" or an "elastic part" 124. The first plate 121 is attached to the rear surface of the flexible display panel 110. The second plate 122 is disposed opposite the first plate 121 while being spaced apart therefrom. The elastic part 124 is disposed between the first plate 121 and the second plate 122 and changes the gap between the first plate 121 and the second plate 122 in order to adjust the bending stiffness of the display unit 100.

The backplate 120 includes a protective film 129, which is coupled to a rear surface of the second plate 122. The protective film 129 shields a through-hole 123 (refer to FIG. 3), which is formed in the second plate 122, and prevents the introduction of moisture or foreign substances into the backplate 120. The backplate 120 may be formed of a metal material. Thus, the protective film 129 is provided to prevent corrosion of the surface of the second plate 122 and accidents caused by the second plate 122 formed of a metal material. A more detailed explanation of the backplate 120 will be made later.

The roller 131, around which the display unit 100 is rolled up or from which the display unit 100 is unrolled, is disposed inside the case 130. The case 130 has therein an entrance 132, through which the display unit 100 is introduced into or drawn out of the case 130. A separate driving motor may be provided in order to automatically roll the roller 131, or a user may manually roll the roller 131. The size of the case 130 is determined by the diameter of the roller 131. For example, it is possible to manufacture cases having various sizes from the size of a pen to a large size capable of being hung on a wall.

The display unit 100 may be provided at an end thereof with a stopper 111 for restricting the distance to which the display unit 100 is introduced into the case 130. The stopper 111 may also be used as a knob, with which a user pulls the display unit 100 out of the case 130.

Hereinafter, various embodiments of the backplate will be described in detail.

Figure 3:
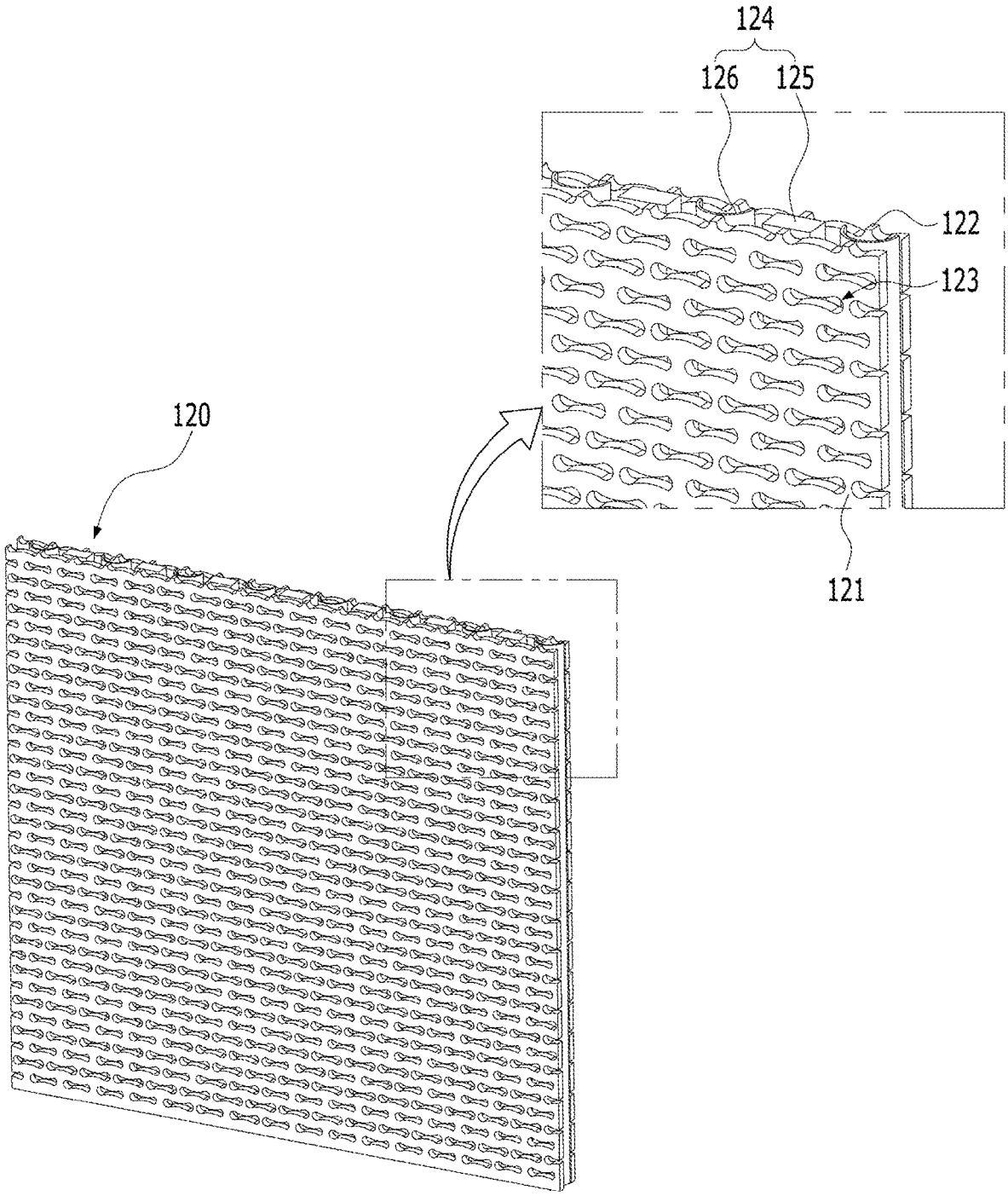
FIG. 3 is a perspective view of a backplate according to a first embodiment.
Figure 4:
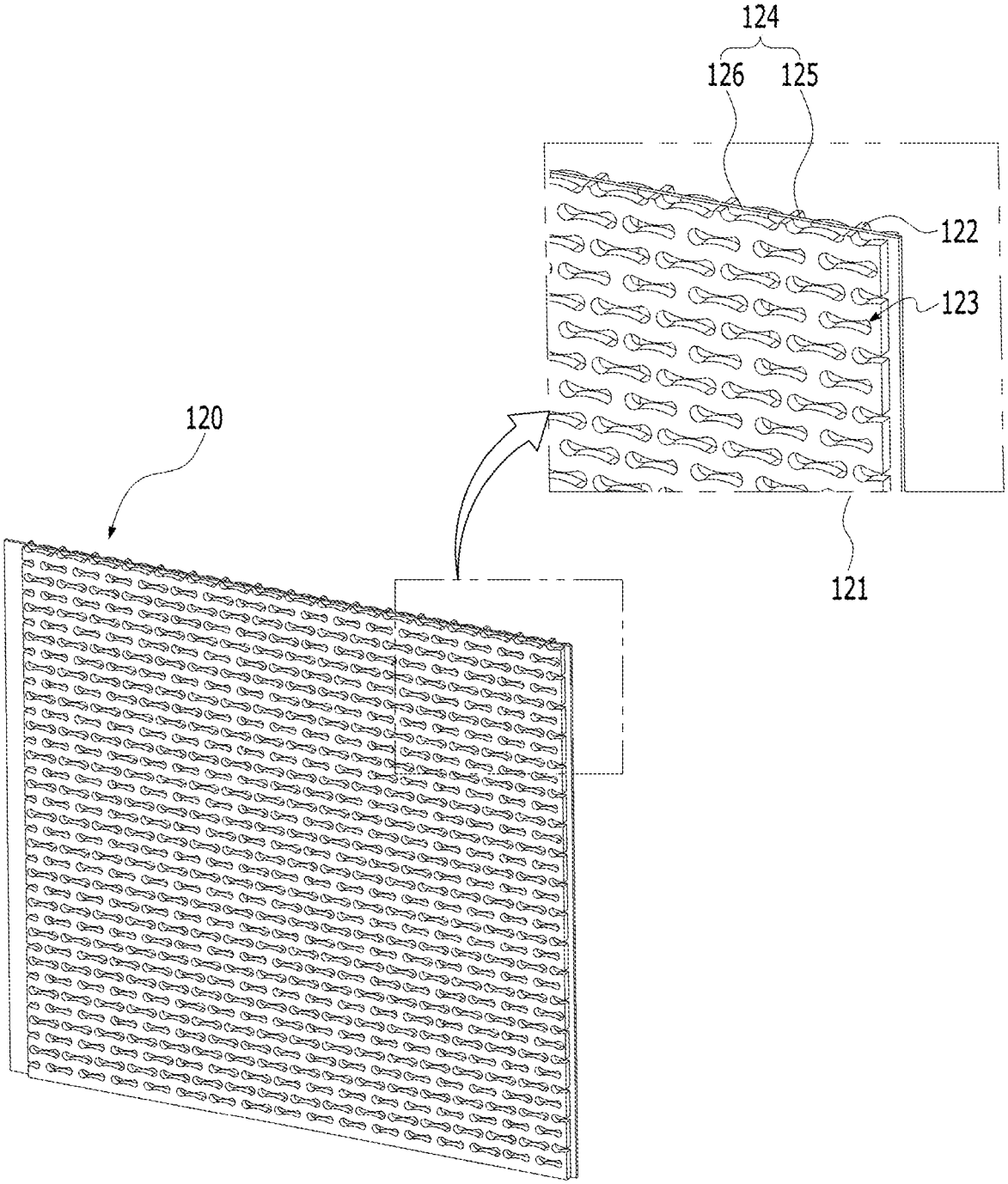
FIG. 4 is a perspective view of the compressed state of the backplate shown in FIG. 3.
Figure 5:
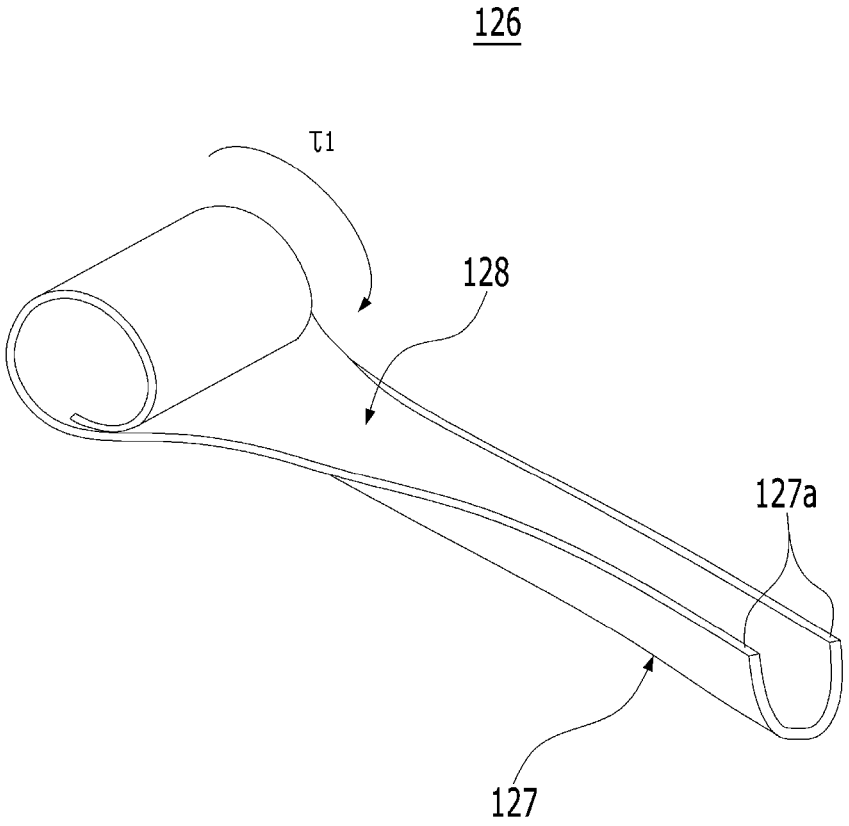
FIG. 5 is a partially enlarged perspective view of the rolling tube shown in FIG. 3.

FIG. 3 is a perspective view of a backplate according to a first embodiment, FIG. 4 is a perspective view of the compressed state of the backplate shown in FIG. 3, and FIG. 5 is a partially enlarged perspective view of a rolling tube 126 shown in FIG. 3.

The backplate 120 according to the first embodiment includes a first plate 121, a second plate 122, and an elastic part 124.

As shown in FIG. 3, each of the first plate 121 and the second plate 122 may have therein a plurality of through-holes 123, which are formed in a predetermined pattern, in order to facilitate the rolling-up motion thereof or to enable rolling-up with a small radius when the roller 131 provided in the case 130 is small. Thus, due to the through-holes 123 formed in a predetermined pattern, the first plate 121 and the second plate 122 may be smoothly bent, or may be easily rolled around a small roller 131. Alternatively, the first plate 121 and the second plate 122 may be planar plates having no through-holes therein. Alternatively, the through-holes 123 may be formed in a predetermined pattern in only one of the first plate 121 and the second plate 122.

When the backplate 120 is rolled around the roller 131 together with the flexible display panel 110, the first plate 121 is located further outwards than the second plate 122, and the second plate 122 is located at the innermost side. As the backplate 120 is rolled around the roller 131, the gap between the first plate 121 and the second plate 122 is reduced to a first gap, as shown in FIG. 4. As the backplate 120 is unrolled from the roller 131 and becomes planar in shape, the gap between the first plate 121 and the second plate 122 is increased to a second gap, as shown in FIG. 3.

Each of the first plate 121 and the second plate 122 is formed of a thin metal material, and supports the flexible display panel 110.

The elastic part 124 includes a piece or member of flexible and/or elastic material, which may be referred to herein as a "pad" or a "pad part" 125, and a rolling tube 126.

The pad part 125 is resiliently compressed so as to maintain the second gap between the first plate 121 and the second plate 122 in the state in which the display unit 100 is rolled out from the case 130 and to maintain the first gap between the first plate 121 and the second plate 122 in the state in which the display unit 100 is rolled into the case 130. The pad part 125 may be formed of rubber, polyurethane (PU) or hollow polycarbonate, which has a constant thickness and is deformable only in a compression direction.

The rolling tube 126 includes a first surface 127, which has a U-shaped cross-section and has a center portion protruding in an arc shape, a second surface 128, which is formed opposite the first surface 127 and has a concave center portion, and support legs, which may be referred to herein as "support portions" 127*a*, which extend to the opposite end portions of the first surface 127 or the second surface 128. A plurality of rolling tubes 126 and a plurality of pad parts 125 may be alternately arranged parallel to each other. The interval or number of the pad parts 125 or the rolling tubes 126 may be varied depending on the bending stiffness of the display unit 100.

The rolling tube 126 is disposed such that the first surface 127 is attached to any one of the first plate 121 and the second plate 122 and the second surface 128 contacts the other one of the first plate 121 and the second plate 122. Preferably, in the state in which the rolling tube 126 is rolled out in a U-shape, the first surface 127 is attached to the inner surface of the first plate 121, the second surface 128 is disposed so as to face the second plate 122, and the support portions 127*a* are disposed in contact with the second plate 122 to support the same. This is because the rolling motion is easily realized when the first surface 127 is disposed further outwards than the second surface 128. As the rolling tube 126 is rolled up, the gap between the first plate 121 and the second plate 122 decreases, and the second surface 128 approaches the inner surface of the first plate 121. Accordingly, the distance between the support portions 127*a* increases, and the second surface 128 and the first surface 127 gradually become planar in shape.

When the rolling motion occurs, the flexible display panel 110 is disposed at the outermost side, and the first plate 121 and the second plate 122 are sequentially disposed such that the second plate 122 is disposed at the innermost side. As the second surface 128 and the first surface 127 gradually become planar in shape, the rolling tube 126 comes into close contact with the second plate 122 and provides the curling force caused by the rolling to the second plate 122. A detailed explanation of the curling force of the rolling tube 126 will be made later.

The bending stiffness of the backplate 120 is proportional to the thickness of the elastic part 124. That is, the larger the thickness of the elastic part 124, the higher the bending stiffness of the backplate 120. Thus, the bending stiffness of the backplate 120 may be adjusted by adjusting the thicknesses of the first plate 121 and the second plate 122 or the thickness of the elastic part 124 depending on the size of the rollable display device 10.

As shown in FIG. 5, when at least a portion of the first surface 127 and at least a portion of the second surface 128 are pressed to become planar in shape, curling force $\tau 1$ is generated in the rolling tube 126 in the rolling direction around the roller 131. When the first surface 127 and the second surface 128 spread in a substantially U-shape in the longitudinal direction thereof, supporting force maintaining this spread state is generated. The rolling tube 126 is formed of a metal material, which withstands high temperature and humidity, preferably a stainless steel (SUS) material.

With the application of the rolling tube 126, when the backplate 120 is rolled up, the backplate 120 is more easily rolled around the roller 131 due to the curling force $\tau 1$ of the rolling tube 126. Further, the rolled-out portion of the backplate 120, which is located outside the entrance 132, maintains the spread state due to the supporting force of the rolling tube 126. In this manner, the backplate 120 securely supports the flexible display panel 110.

Figure 6:
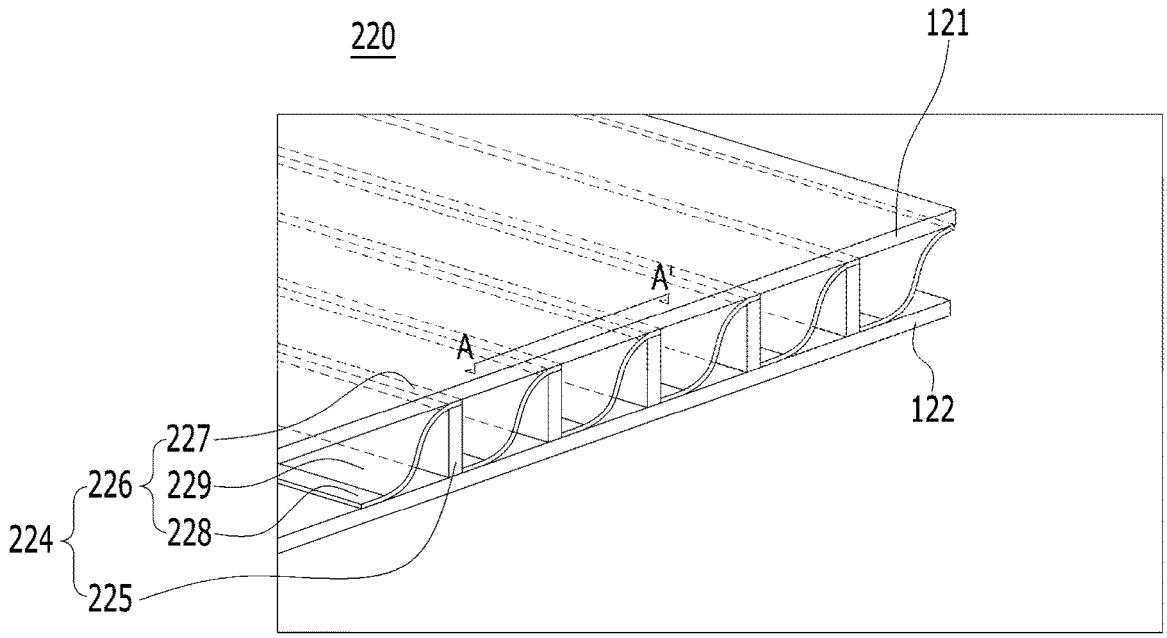
FIG. 6 is a perspective view of a backplate according to a second embodiment.
Figure 7:
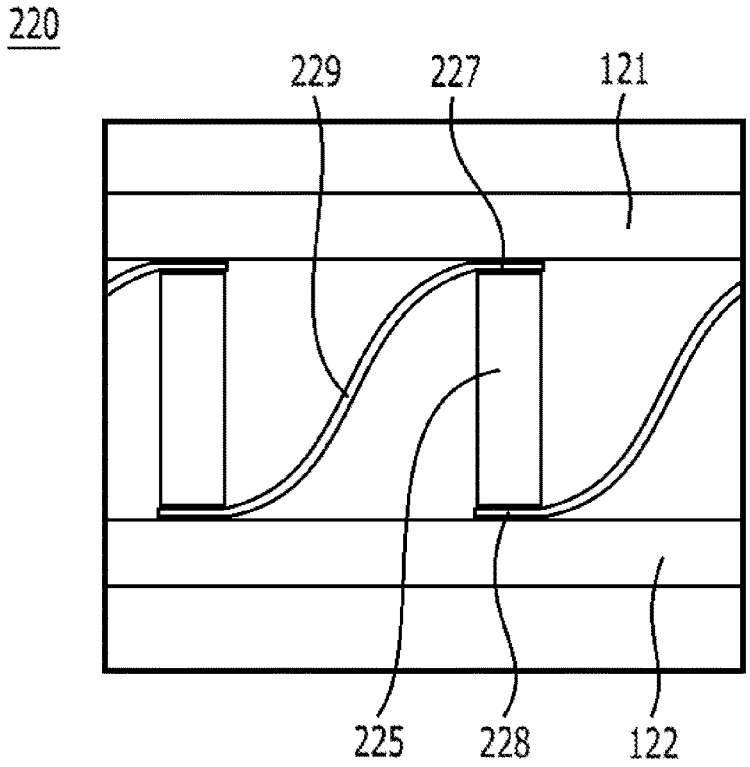
FIG. 7 is a cross-sectional view of the backplate shown in FIG. 6, which is taken along line A-A' in FIG. 6.
Figure 8:
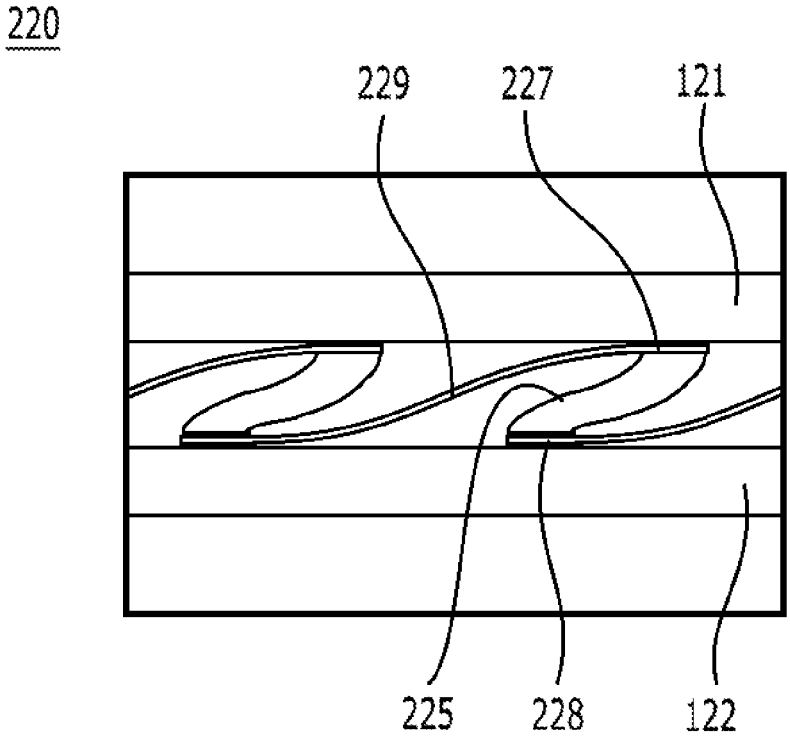
FIG. 8 is a front view of the backplate shown in FIG. 7 in the state in which the backplate is rolled up or pressed and is reduced in thickness.

FIG. 6 is a perspective view of a backplate according to a second embodiment, FIG. 7 is a cross-sectional view of the backplate shown in FIG. 6, which is taken along line A-A' in FIG. 6, and FIG. 8 is a front view of the backplate shown in FIG. 7 in the state in which the backplate is rolled up or pressed and is reduced in thickness.

Referring to FIGS. 6 to 8, the backplate 220 according to the second embodiment includes a first plate 121, a second plate 122, and a flexible or elastic layer, which may be referred to herein as an "elastic member" or an "elastic part" 224.

The elastic part 224 of the backplate 220 according to the second embodiment includes a first piece or member of flexible or elastic material, which may be referred to herein as a "pad" or a "pad part" 225, and a second piece or member of flexible or elastic material, which may be referred to herein as a "core" or a "core part" 226.

Since the pad part 225 has the same configuration as the pad part according to the first embodiment, a duplicate explanation thereof will be omitted.

The core part 226 includes a first attachment portion 227, which is attached to a rear surface of the first plate 121, a second attachment portion 228, which is attached to the second plate 122, and a connection portion 229, which resiliently connects the first attachment portion 227 and the second attachment portion 228. Specifically, the first attachment portion 227 corresponds to a front surface of one end portion of the core part 226, and the second attachment portion 228 corresponds to a rear surface of the opposite end portion of the core part 226.

The core part 226 is formed in a substantially S-shape, and the opposite end portions of the core part 226 are respectively attached to the first plate 121 and the second plate 122 in order to connect the first plate 121 and the second plate 122 to each other. In addition, the pad part 225 resiliently connects the first plate 121 and the second plate 122 to each other. One end portion of the pad part 225 may be attached to a rear surface of the first attachment portion 227, and the opposite end portion of the pad part 225 may be attached to a front surface of the second attachment portion 228. Alternatively, the pad part 225 may not be attached to the core part 226, but may be attached to the first plate 121 and the second plate 122. Alternatively, any one of the opposite end portions of the pad part 225 may be attached either to the first attachment portion 227 or to the second attachment portion 228. Preferably, one of the opposite end portions of the pad part 225 is attached either to the first plate 121 or to the second plate 122, and the other one of the opposite end portions of the pad part 225 is attached either to the first attachment portion 227 or to the second attachment portion 228.

As such, if the pad part 225 is attached to different portions of the core part 226, it is possible to easily respond to variation in the gap between the first plate 121 and the second plate 122.

For example, if one end portion of the pad part 225 is attached to a rear surface of the first attachment portion 227 and the opposite end portion thereof is attached to a front surface of the second attachment portion 228, the elastic part 224 is formed in an integral structure, thus facilitating the attachment of the elastic part 224 between the first plate 121 and the second plate 122.

A plurality of pad parts 225 and a plurality of core parts 226 may be provided. In addition, the direction in which the core parts 226 extend from the first plate 121 to the second plate 122 is uniform, whereby the direction in which the first plate 121 and the second plate 122 slip relative to each other due to reduction in the gap between the first plate 121 and the second plate 122 may be set to be uniform. For example, if the core parts 226 are disposed so as to be oriented in the same direction between the first plate 121 and the second plate 122, when the gap between the first plate 121 and the second plate 122 is reduced, as show in FIG. 8, the pad parts 225 and the core parts 226 are deformed in the same direction. Thus, the direction in which the first plate 121 and the second plate 122 slip relative to each other is set by the direction in which the core parts 226 are deformed (slanted) between the first plate 121 and the second plate 122.

Accordingly, it is possible to predict the direction in which the first plate 121 and the second plate 122 slip relative to each other. In addition, when the backplate 220 is rolled up, it is possible to prevent the first plate 121 and the second plate 122 from slipping in a direction different from the rolling-in direction, thereby realizing a more precise roll-up structure.

Although not illustrated in the drawings, the core parts 226 may be formed to have different lengths from each other in order to adjust the bending stiffness of the backplate 220. That is, the core parts 226 having different lengths from each other may be attached to appropriate portions of the first plate 121 and the second plate 122 while maintaining a constant gap between the first plate 121 and the second plate 122. In this case, it is possible to further increase the bending stiffness of the backplate 220 by disposing a relatively short core part 226 at a specific location or region.

Figure 9:
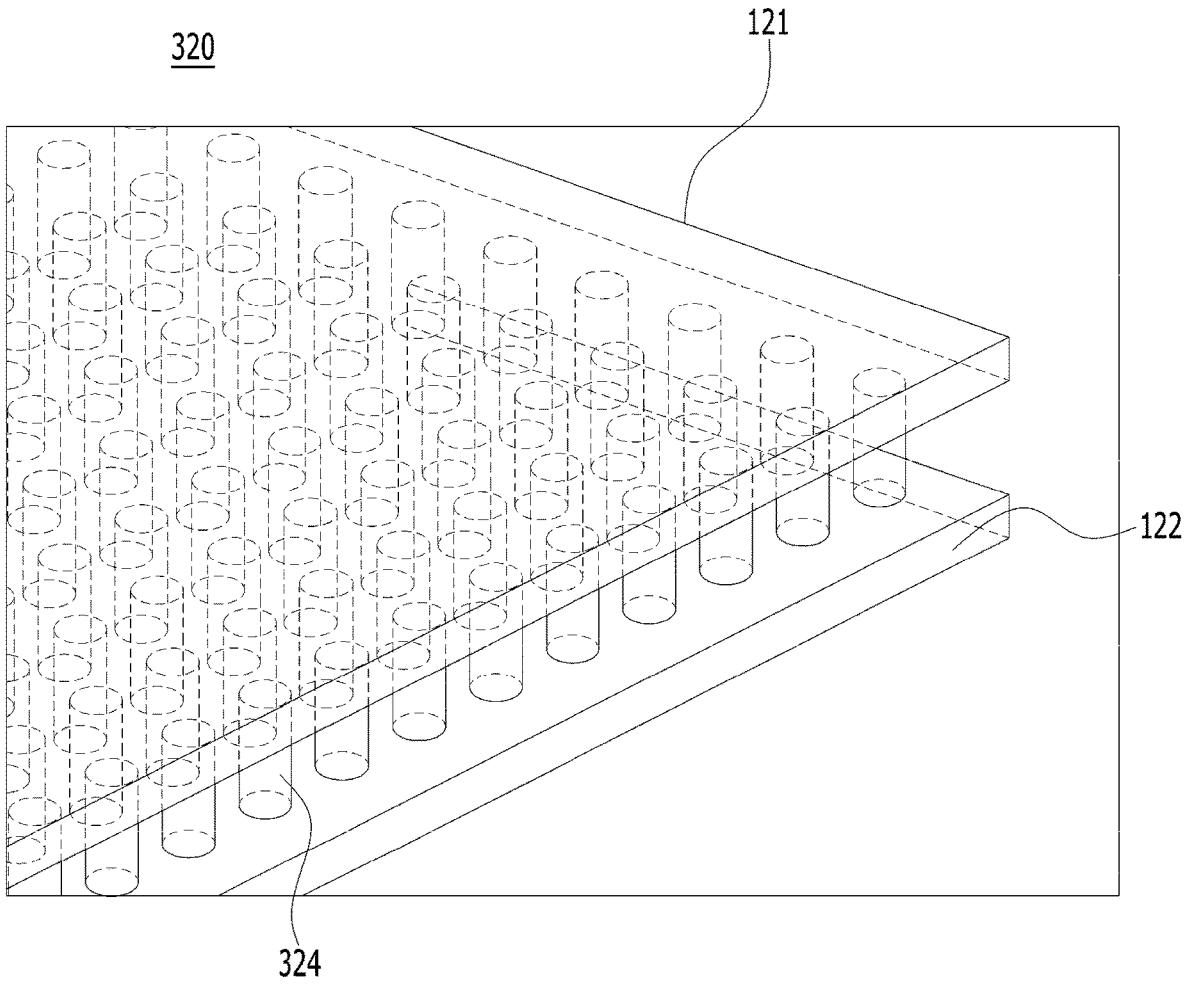
FIG. 9 is a perspective view of a backplate according to a third embodiment.
Figure 10:
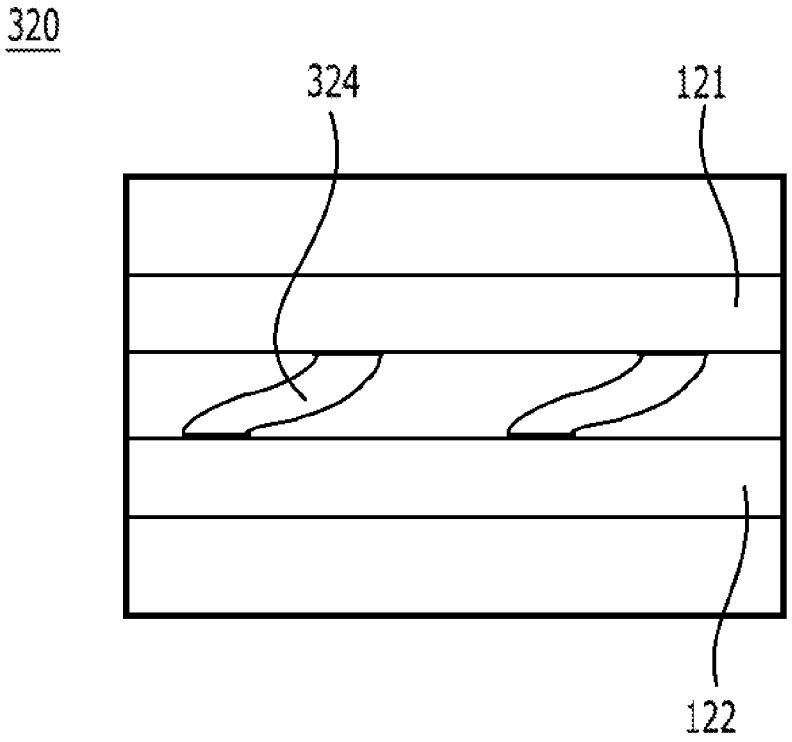
FIG. 10 is a front view of the backplate shown in FIG. 9 in the state in which the backplate is rolled up or pressed and is reduced in thickness.

FIG. 9 is a perspective view of a backplate according to a third embodiment, and FIG. 10 is a front view of the backplate shown in FIG. 9 in the state in which the backplate is rolled up or pressed and is reduced in thickness.

Referring to FIGS. 9 and 10, the backplate 320 according to the third embodiment includes a first plate 121, a second plate 122, and a flexible or elastic layer, which may be referred to herein as an "elastic member" or an "elastic part" 324.

In the backplate 320 according to the third embodiment, a plurality of elastic parts 324 is arranged in a predetermined pattern between the first plate 121 and the second plate 122.

Each of the elastic parts 324 may be formed of a fiber material, preferably carbon fiber, which has excellent strength and elasticity.

Each of the elastic parts 324 may be embodied as a cylindrical-shaped pad part, which connects the first plate 121 and the second plate 122 to each other.

In the state in which the backplate 320 is rolled out, the elastic parts 324 maintain a constant gap between the first plate 121 and the second plate 122. When the backplate 320 is rolled up, all of the elastic parts 324 uniformly slant or lie so as to reduce the gap between the first plate 121 and the second plate 122. Further, since the elastic parts 324 are highly elastic, even when the gap between the first plate 121 and the second plate 122 is increased, the elastic parts 324 are immediately restored to the original shapes thereof and thus again maintain a constant gap between the first plate 121 and the second plate 122.

Figure 11A:
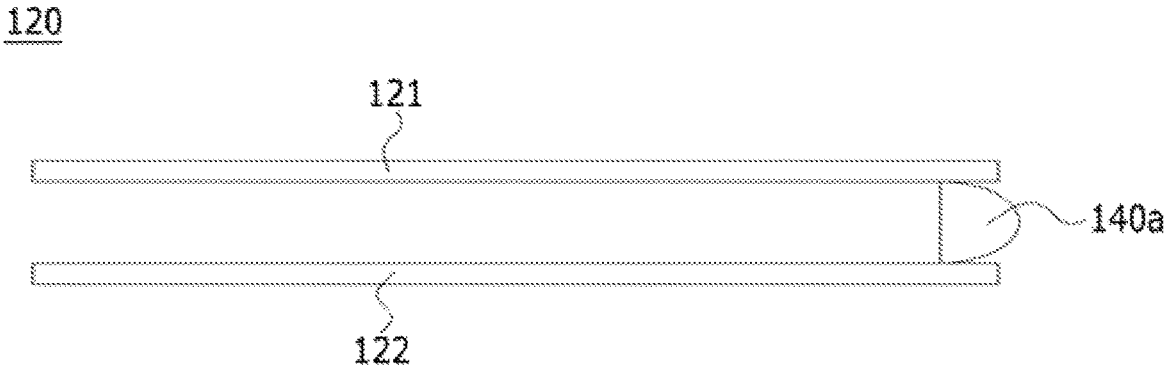
FIGS. 11A-11C are enlarged cross-sectional views of the edge area of the backplate in the edge area of the display unit shown in FIG. 1.
Figure 11B:
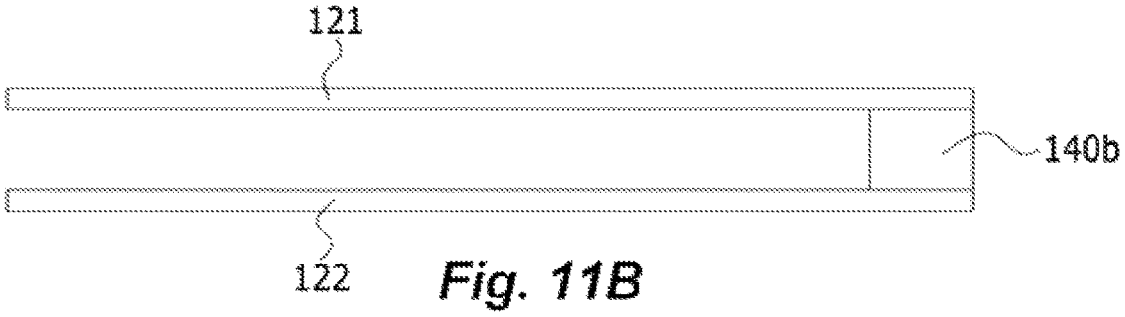
Figure 11C:
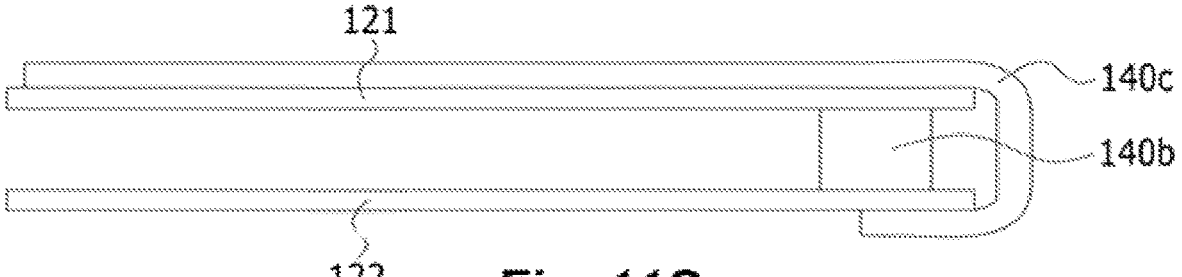

FIGS. 11A-11C are enlarged cross-sectional views of the edge area of the backplate in the edge area of the display unit shown in FIG. 1.

Referring to FIGS. 11A-11C, a plug or cover or edge seal, which may be referred to as a "finishing part" 140*a*, 140*b* and 140*c*, is provided at the edge area of the backplate 120 in order to cover a region between the first plate 121 and the second plate 122.

The finishing part 140*a*, 140*b* and 140*c* may be formed of elastic resin or foam so as to be changed in external shape in order to respond to the change in the gap between the first plate 121 and the second plate 122 and the slippage thereof.

As shown in FIG. 11A, in the case in which the finishing part 140*a* is formed of resin, the finishing part 140*a* may be disposed so as to seal not only the gap between the first plate 121 and the second plate 122 but also the gap between the flexible display panel 110 (refer to FIG. 1), coupled to the front surface of the backplate 120, and the backplate 120.

As shown in FIG. 11B, in the case in which the finishing part 140*b* is formed of the same material as the pad part 125 (refer to FIG. 3), the finishing part 140*b* may be disposed at the edge area between the first plate 121 and the second plate 122 and may seal the gap between the first plate 121 and the second plate 122.

As shown in FIG. 11C, in addition to the structure shown in FIG. 11B, the finishing part 140C may be further provided in order to cover the external surfaces of the edge areas of the first plate 121 and the second plate 122. In this case, since the finishing part 140C also covers the rear surface of the backplate 120, a separate protective film is not necessary.

As is apparent from the above description, the backplate and the rollable display device including the same have the following effects.

First, when the flexible display panel is rolled around the roller, the backplate is reduced in thickness and volume, thus facilitating storage and improving portability.

Second, when the flexible display panel is unrolled from the roller, the backplate is increased in thickness and supports the rear surface of the flexible display panel, thus providing more secure supporting force.

Third, since the flexible display panel is securely supported, the flexible display panel is prevented from undulating or overturning due to external force.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

The invention claimed is:

1. A backplate, comprising:

a first plate coupled to a rear surface of a flexible display panel configured to be bent smoothly;

a second plate spaced apart from the first plate and located opposite to the first plate across a space between the first plate and the second plate; and an elastic layer located between the first plate and the second plate, the elastic layer configured to resiliently change a distance between the first plate and the second plate, the elastic layer including:

a plurality of first patterns disposed parallel to each other while being spaced apart from each other between the first plate and the second plate, each of the plurality of first patterns being coupled at opposite side surfaces thereof to a surface of the first plate and a surface of the second plate that face each other, the plurality of first patterns being configured to be resiliently changed in thickness; and a plurality of second patterns parallel to the plurality of first patterns, each of the plurality of second patterns being disposed between two successive ones of the plurality of first patterns and being thinner than each of the plurality of first patterns.

2. The backplate according to claim 1, wherein at least one of the first plate and the second plate has through-holes extending from a front surface thereof to a rear surface thereof.

3. The backplate according to claim 1, wherein the first plate, the second plate, and the elastic layer are rolled up together in a rolled assembly such that the first plate is located at an outer side of the rolled assembly and the second plate is located at an inner side of the rolled assembly.

4. The backplate according to claim 1, wherein each of the plurality of second patterns is a rolling tube at least partially coupled to any one of the first plate and the second plate.

5. The backplate according to claim 4, wherein, in an at least partially unrolled state, each of the rolling tubes comprises:

a first surface located at a first side thereof, the first surface having a U-shaped cross-section;

a second surface located at a second side thereof opposite to the first side, the second surface having a concave shape; and support legs located at opposite ends of the first surface or the second surface.

6. The backplate according to claim 5, wherein, when the distance between the first plate and the second plate is reduced, each of the rolling tubes is rolled up such that the first surface is located at an outer side and the second surface is located at an inner side in a direction in which the first plate, the second plate and the elastic layer are rolled up together.

7. The backplate according to claim 6, wherein:

when each of the rolling tubes is rolled up, curling force is generated in each of the rolling tubes in a rolling direction, and when each of the rolling tubes is spread, supporting force is generated in each of the rolling tubes to maintain the first plate and the second plate to be planar in shape.

8. The backplate according to claim 5, wherein, when the first plate and the second plate spread into a planar shape, each of the rolling tubes is increased in height to increase the distance between the first plate and the second plate.

9. The backplate according to claim 1, wherein each of the plurality of second patterns is an elastic material, has an S-shaped cross-section and includes a first attachment portion coupled to the first plate, the first attachment portion corresponding to a front surface of one end portion of the second pattern, a second attachment portion coupled to the second plate, the second attachment portion corresponding to a rear surface of an opposite end portion of the second pattern, and a connection portion resiliently connecting the first attachment portion and the second attachment portion.

10. The backplate according to claim 9, wherein each of the plurality of first patterns is attached at one end portion thereof to a rear surface of the first plate and is attached at an opposite end portion thereof to a front surface of the second attachment portion.

11. The backplate according to claim 9, wherein a direction in which the plurality of second patterns extend from the first plate to the second plate to connect the first plate and the second plate is uniform.

12. The backplate according to claim 1, wherein, when a shortest straight-line distance between the first plate and the second plate is changed, the elastic layer causes the first plate and the second plate to slip in a direction perpendicular to a direction in which the shortest straight-line distance between the first plate and the second plate is changed.

13. The backplate according to claim 1, further comprising:

an edge seal located at an edge area of the first plate and an edge area of the second plate between the first plate and the second plate.

14. A rollable display device, comprising:

a flexible display panel configured to be bent smoothly;

a backplate coupled to a rear surface of the flexible display panel, the backplate including:

a first plate coupled to the rear surface of the flexible display panel;

a second plate disposed opposite the first plate while being spaced apart from the first plate; and an elastic part disposed between the first plate and the second plate, the elastic part being configured to resiliently change a distance between the first plate and the second plate, the elastic part including:

a plurality of first patterns disposed parallel to each other while being spaced apart from each other between the first plate and the second plate, each of the plurality of first patterns being coupled at opposite side surfaces thereof to a surface of the first plate and a surface of the second plate that face each other, the plurality of first patterns being configured to be resiliently changed in thickness; and a plurality of second patterns parallel to the plurality of first patterns, each of the plurality of second patterns being disposed between two successive ones of the plurality of first patterns and being thinner than each of the first patterns; and a case accommodating a roller configured to roll or unroll the flexible display panel and the backplate together, the case having an entrance through which the flexible display panel and the backplate are together introduced into or drawn out of the case, wherein, when the flexible display panel and the backplate are rolled around the roller and are accommodated in the case through the entrance, the backplate is gradually reduced in thickness.

15. The rollable display device according to claim 14, wherein the backplate further includes an edge seal located at an edge area of the first plate and an edge area of the second plate between the first plate and the second plate.

16. The rollable display device according to claim 14, wherein each of the plurality of second patterns is a rolling tube at least partially coupled to any one of the first plate and the second plate.

17. The rollable display device according to claim 16, wherein:

when each of the rolling tubes is rolled up, curling force is generated in each of the rolling tubes in a rolling direction, and when each of the rolling tubes is spread, supporting force is generated in each of the rolling tubes to maintain the first plate and the second plate to be planar in shape.

18. The rollable display device according to claim 14, wherein each of the plurality of second patterns is a flexible material, has an S-shaped cross-section and includes a first attachment portion coupled to the first plate, the first attachment portion corresponding to a front surface of one end portion of the second pattern, a second attachment portion coupled to the second plate, the second attachment portion corresponding to a rear surface of an opposite end portion of the second pattern, and a connection portion resiliently connecting the first attachment portion and the second attachment portion.

19. The rollable display device according to claim 18, wherein, when a shortest straight-line distance between the first plate and the second plate is changed, the elastic part causes the first plate and the second plate to slip in a direction perpendicular to a direction in which the shortest straight-line distance between the first plate and the second plate is changed, and wherein the second plate slips closer to the entrance of the roller than the first plate.

20. The rollable display device according to claim 14, wherein the first plate and the second plate are metal plates.

* * * * *